US012617738B2

(12) United States Patent
Deppert et al.

(10) Patent No.: US 12,617,738 B2
(45) Date of Patent: May 5, 2026

(54) REMOVING DISSOLVED GASSES FROM PROPELLANT COMPOSITIONS

(71) Applicants: Goodrich Corporation, Charlotte, NC (US); Raytheon Company, Waltham, MA (US)

(72) Inventors: Thomas Michael Deppert, Gilbert, AZ (US); Luis G. Interiano, Galt, CA (US); Jerry A. Lambert, Dixon, CA (US); Carl Shanholtz, Fort Ashby, WV (US)

(73) Assignees: GOODRICH CORPORATION, Charlotte, NC (US); RAYTHEON COMPANY, Waltham, MA (US)

( * ) Notice: Subject to any disclaimer, the term of this patent is extended or adjusted under 35 U.S.C. 154(b) by 1124 days.

(21) Appl. No.: 17/666,837

(22) Filed: Feb. 8, 2022

(65) Prior Publication Data

US 2023/0250038 A1 Aug. 10, 2023

(51) Int. Cl.
*C06B 21/00* (2006.01)

(52) U.S. Cl.
CPC ..... *C06B 21/0091* (2013.01)

(58) Field of Classification Search
None
See application file for complete search history.

(56) References Cited

U.S. PATENT DOCUMENTS

| | | | | |
|---|---|---|---|---|
| 3,380,715 | A | 4/1968 | Schee | |
| 4,000,023 | A | 12/1976 | Oberth et al. | |
| 4,298,552 | A | 11/1981 | Gimler | |
| 8,309,001 | B2 | 11/2012 | Kaully et al. | |
| 8,357,251 | B2 | 1/2013 | Watson | |
| 2011/0073224 | A1* | 3/2011 | Heister | C06B 21/0025 149/109.6 |

OTHER PUBLICATIONS

Oberth, "Chapter 6—Binder-Filler Interaction And Bonding Agents", Principles of Solid Propellant Development, CPIA Publication 469, Sep. 1987, 20 pages.

* cited by examiner

*Primary Examiner* — Aileen B Felton
(74) *Attorney, Agent, or Firm* — CANTOR COLBURN LLP

(57) ABSTRACT

A method for removing a gas from a propellant composition includes providing an uncured propellant composition comprising a bonding agent, energetic particles, and a polymeric binder, and flowing an inert gas through the uncured propellant composition to remove an evolved gas from the uncured propellant composition.

11 Claims, 5 Drawing Sheets

REMOVING DISSOLVED GASSES FROM PROPELLANT COMPOSITIONS

BACKGROUND

Exemplary embodiments pertain to the art of propellants, and more specifically, to removing dissolved gasses from propellant compositions.

Solid propellant compositions include solid energetic particles dispersed in a rubbery matrix, called a binder. A bonding agent coats the solid energetic particle surfaces and bonds to the polymeric binder either chemically or adhesively. Generally, an effective bonding agent will coat the energetic particle surfaces, chemically react to form an encapsulating film around the particles, and bond to the binder either chemically or adhesively. If the bonding agent film has sufficient affinity for the energetic particle surface, it will prevent binder from separating from the energetic particles when subjected to stress. The bonding agent may be coated onto the energetic particles either before incorporation into the propellant composition mix or, in some cases, during the composition mixing operation.

Compounds that release oxidizing chemical species to the combustion process and/or liberate energy upon decomposition are examples of type of solid energetic particles. Since the oxidizers can make up a majority of the particulate matter, the bonds between the binders and the oxidizer particles have significant effects on structural properties.

Methods of making propellant compositions include combining energetic particles with bonding agents and a polymeric binder to form a viscous slurry. The propellant slurry is poured or cast into the rocket motor case and cured in a large oven to form the final propellant. Curing transforms the slurry into a hard, rubbery material, or propellant grain.

BRIEF DESCRIPTION

Disclosed in embodiments is a method for removing a gas from a propellant composition includes providing an uncured propellant composition comprising a bonding agent, energetic particles, and a polymeric binder, and flowing an inert gas through the uncured propellant composition to remove an evolved gas from the uncured propellant composition.

In further embodiments, the inert gas is nitrogen gas ($N_2$), argon gas (Ar), helium gas (He), or any combination thereof.

In further embodiments, the uncured propellant composition is in a mixing container, and flowing the inert gas includes rotating the uncured propellant composition around a central axis of the mixing container.

In further embodiments, the mixing is performed at room temperature.

In further embodiments, the mixing container further includes a gas inlet and a vent for flowing the inert gas through the uncured propellant composition and out of the mixing container, respectively.

In further embodiments, the methods include venting the inert gas and the gas from the mixing container.

In further embodiments, the bonding agent is a tetraethylenepentamine acrylonitrile glycidol adduct, reaction product of tetraethylenepentamine and acrylonitrile, C-1, diethylenetriamine, or a combination thereof.

Also disclosed in embodiments is a method for removing a gas from a propellant composition that includes disposing a bonding agent, energetic particles, and a polymeric binder in a mixing container. The bonding agent, the energetic particles, and polymeric binder form a propellant composition. The method includes rotating the mixing container about its central axis to mix the propellant composition. The method further includes flowing, while rotating, an inert gas through the propellant composition to remove an evolved gas from the propellant composition.

In further embodiments, the inert gas is nitrogen gas, argon gas, helium gas, or any combination thereof.

In further embodiments, the mixing is performed at room temperature.

In further embodiments, the mixing container further includes a gas inlet and a vent for flowing the inert gas through the propellant composition.

In further embodiments, the method further includes venting the inert gas and the gas from the mixing container.

In further embodiments, the bonding agent is a tetraethylenepentamine acrylonitrile glycidol adduct, reaction product of tetraethylenepentamine and acrylonitrile, N,N'-bis (cyanoethyl)-dihydroxypropyl amine (C-1), diethylenetriamine, or a combination thereof.

Also disclosed in embodiments is an apparatus that includes a mixing container for mixing a propellant composition and configured to rotate about a central axis, a lid coupled to mixing container, and an inert gas inlet on the lid for flowing an inert gas into the mixing container.

In further embodiments, the mixing container has a cylindrical shape.

In further embodiments, the apparatus further includes a vent on the lid for allowing the inert gas to escape from the mixing container.

In further embodiments, the apparatus further includes a pair of rollers coupled to the mixing container configured to rotate the mixing container about the central axis.

In further embodiments, the apparatus further includes a non-rotating disk coupled to the lid.

In further embodiments, the non-rotating disk is coupled to a disk stabilizer arm.

In further embodiments, the disk stabilizer arm is anchored to a substrate.

BRIEF DESCRIPTION OF THE DRAWINGS

The following descriptions should not be considered limiting in any way. With reference to the accompanying drawings, like elements are numbered alike.

DETAILED DESCRIPTION

During mixing of composite propellant compositions, gases can be evolved, which are challenging to remove. Incomplete removal of evolved gases may interfere with the propellant curing process. Removing gases from propellant compositions is both time and labor intensive, sometimes requiring several days of shaking. If the mixing process extends beyond a workday, and the mixture is allowed to stand, the propellant may compact and become difficult to mix, which may affect the quality of the propellant.

Accordingly, described herein is a process and apparatus that includes rolling a mixing apparatus that houses the propellant composition, while sparging with nitrogen gas to facilitate removal of the dissolved gases without allowing uncured propellant to settle. In one or more embodiments, the mixing apparatus includes a housing or container for the propellant composition with slip-fit lid that is designed to allow the gases to flow into and out of the head space of the housing and propellant composition as it rotates on one or more rollers. The continuous rolling of the housing keeps the propellant composition moving so that it does not compact, and continuously exposes fresh propellant surfaces to the inert gas sparge to facilitate gas removal. The processes and apparatuses provide a safe and efficient method for removing gases from uncured propellant compositions and to proceed during off hours without supervision, which prevents or mitigates the propellant from settling and compacting.

Figure 1A:
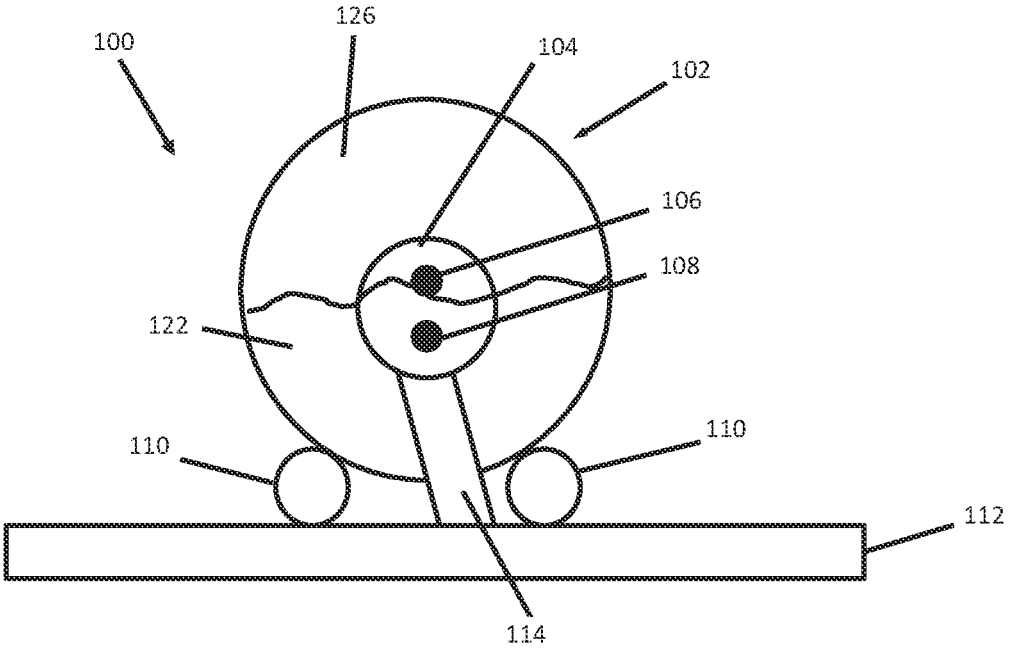
FIG. 1A is a front view of an apparatus according to embodiments of the present disclosure.
Figure 1B:
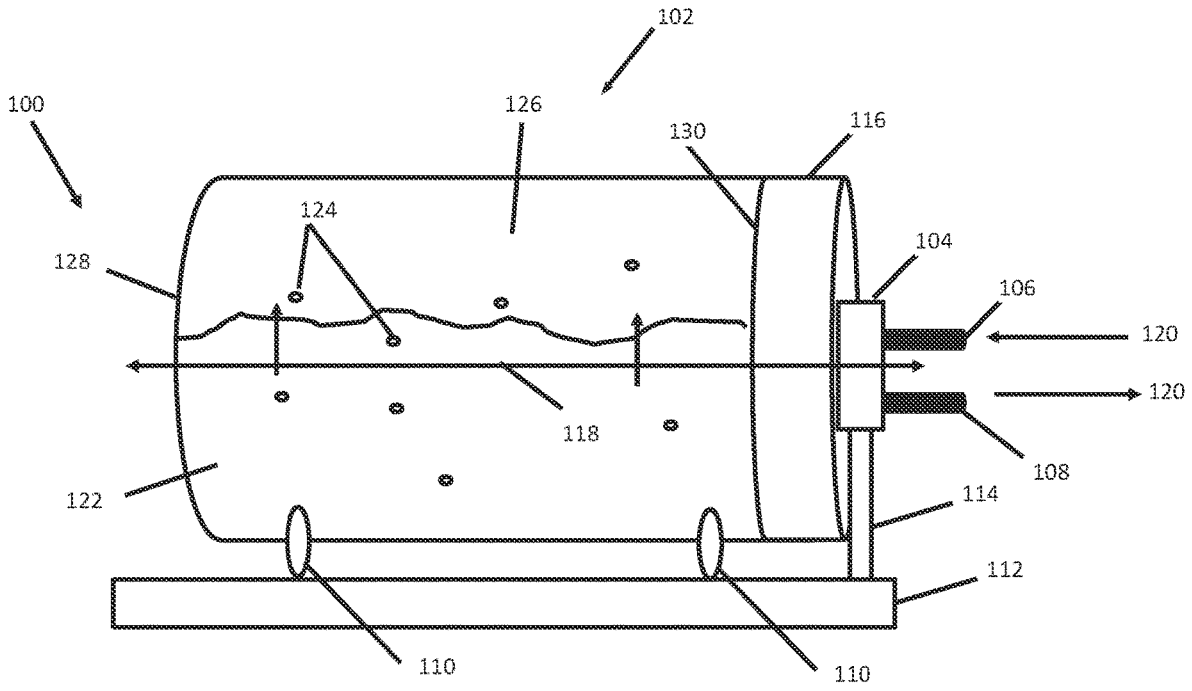
FIG. 1B is a side view of the apparatus of FIG. 1A according to embodiments of the present disclosure.

FIGS. 1A and 1B are front and side views, respectively, of a propellant mixing apparatus 100 according to embodiments of the present disclosure. The propellant mixing apparatus 100 includes a mixing container 102 (or mixing housing) to house and mix the uncured propellant composition. In one or more embodiments, the mixing container 102 has a cylindrical shape but is not limited to this shape. The mixing container 102 is has any shape or dimensions provided that it is sufficient to house an uncured propellant composition 122 and mix the uncured propellant composition 122. The mixing container 102 is of sufficient size that it can accommodate the propellant composition 122 and allow for additional head space 126 for gases 124 to escape. In one or more embodiments, the mixing container 102 is about one-third to about two-thirds full, about half full, or less than half full of the uncured propellant composition 122 during mixing and gas removal.

The mixing container 102 is coupled to one or more, e.g., a plurality or a pair, of rollers 110 also coupled to a substrate 112. In one or more embodiments, the mixing container 102 is housed on a pair or rollers 110. The rollers 110, e.g., the pair of rollers, are configured to rotate the mixing container 102 about the central axis 118. (see below). The mixing container 102 with the uncured propellant composition 122 is rolled on the one or more rollers 110.

The mixing container 102 includes a central axis 118 (see FIG. 1B) that is perpendicular to the planes of the first base 128 (also referred to as a bottom) and second base 130 (also referred to as a top). During mixing, the mixing container 102 rotates around the central axis 118 via rolling of the rollers 110.

The mixing container 102 is coupled to a lid 116 that slides onto an end (the second base 121 or top) of the mixing container 102 and is easily removed and replaced on the mixing container 102. The lid 116 rotates as the mixing container 102 is mixed/rotated. The lid 116 includes a stationary slip disk 104 (or non-rotating slip disk), which is stabilized by being coupled to a disk stabilizer arm 114 that is anchored to the substrate 112. The disk stabilizer arm 114 and stationary slip disk stabilize the rotating mixing container 102 by way of an anchor to the substrate 112.

The lid 116 with the stationary slip disk 104 includes a gas inlet 106 and a vent 108 (also referred to as a gas outlet). The gas inlet 106 allows inert gas 120 to flow into and out of the mixing container 102 as it rotates on the rollers 110.

Figure 3:
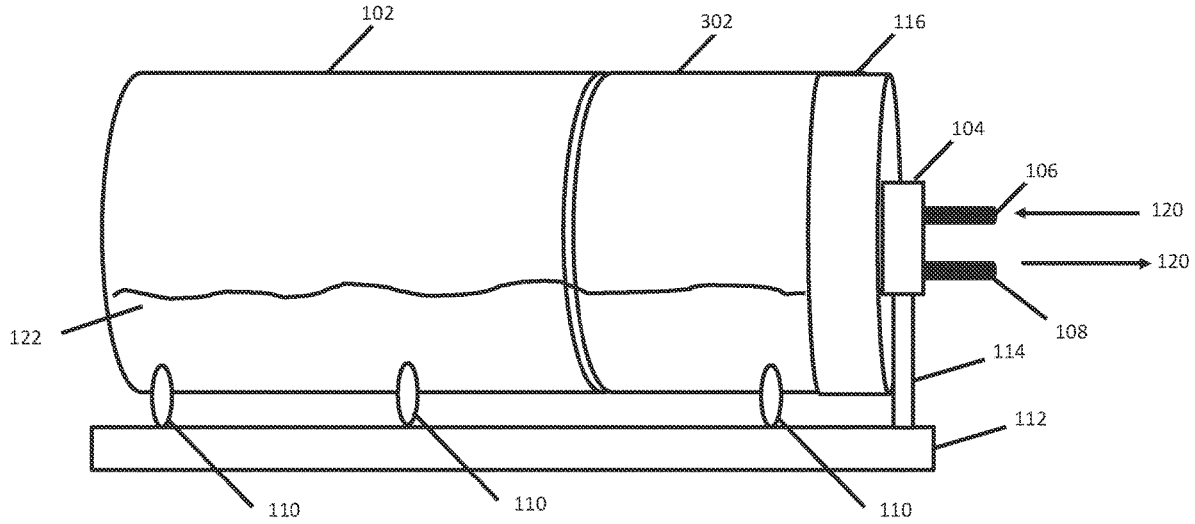
FIG. 3 is a side view of an apparatus according to embodiments of the present disclosure.

In some embodiments, the volume of the propellant in the mixing container 102 is limited to about 20% to 45% of the total volume of the container to prevent the propellant from reaching the vent 108 and gas inlet 106 when the mixing container 102 is rotating. In embodiments, an extension 302 (as shown in FIG. 3) is coupled between the mixing container 102 and the lid 116 to prevent the propellant composition 122 from reaching the vent 108 and gas inlet 106 by expanding the internal volume of the mixing container 102. In one or more embodiments, the extension 302 is equipped with molded vanes in the internal sidewalls to increase the flow of the propellant composition 122 during rotation, causing more efficient exposure of surface area of the propellant composition 122. In other embodiments, the vanes are oriented diagonally so that they will drive the propellant composition 122 to flow back towards the mixing container 102 during rotation and further increase the exposure of new surface area.

The uncured propellant composition 122 is mixed in the mixing container 102 by rotating on the rollers 110 about the central axis 118, and inert gas 120 simultaneously flows into the head space 126 of the mixing container 102. The rolling action of the mixing container 102 keeps the propellant composition 122 moving so that it does not compact, and also continuously exposes fresh propellant surfaces so that the inert gas 120 sparge facilitates removal of dissolved gases 124 that evolve from the propellant composition 122, which is released into the headspace 126 and then out through the vent 108. The vent 108 allows the inert gas 120 and dissolved gases 124 from the propellant to escape from the mixing container 102.

The mixing process has low energy input so that it may be performed without supervision. According to one or more embodiments, the mixing process is performed at room temperature, or a temperature of about 20 to about 25 degrees Celsius. According to other embodiments, heat is applied, and the mixing process is performed at a temperature of about 40 to about 85 degrees Celsius. According to other embodiments, heat is applied, and the mixing process is performed at a temperature of about 65 to about 80 degrees Celsius.

Figure 4:
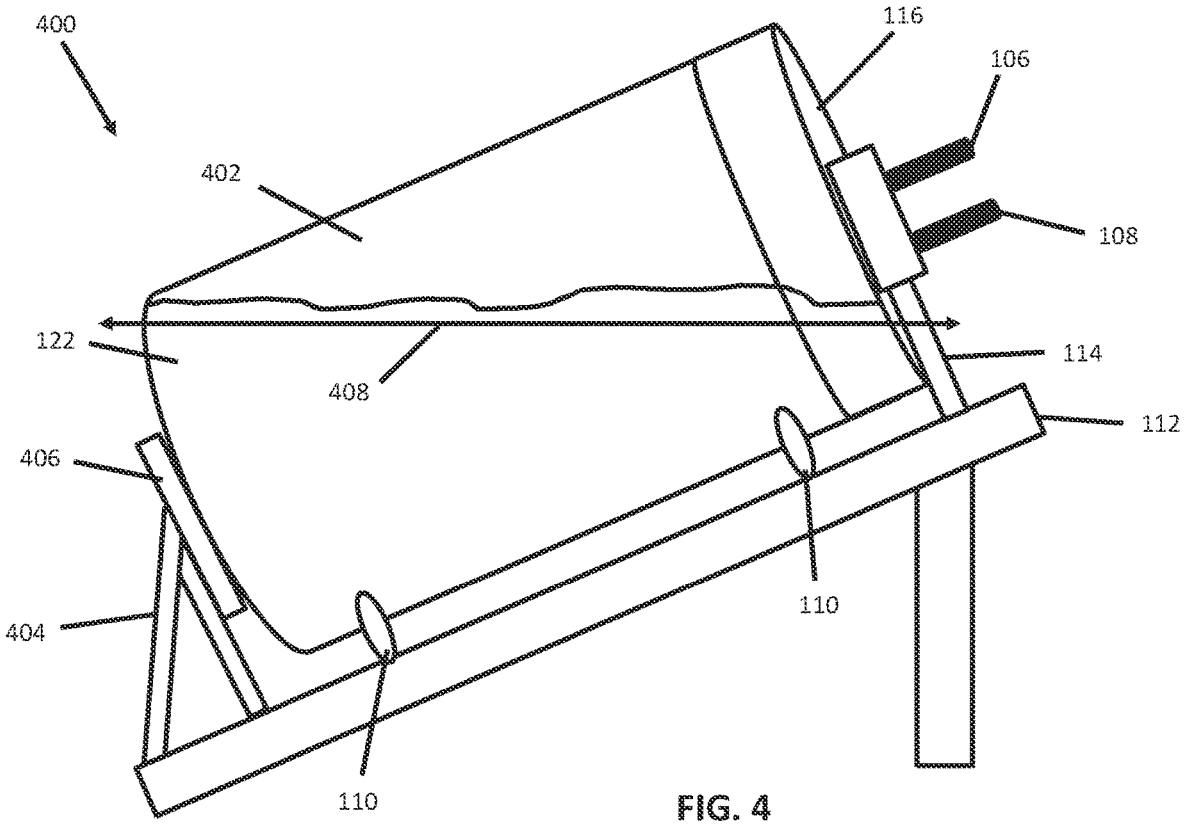
FIG. 4 is an apparatus according to embodiments of the present disclosure.

FIG. 4 is a side view of a propellant mixing apparatus 400 according to embodiments of the present disclosure. The propellant mixing apparatus 400 includes a mixing container 402 (or mixing housing) to house and mix the uncured propellant composition 122. The mixing container 402 is of sufficient size that it can accommodate the propellant composition 122 and allow for additional head space for gases to escape. To accommodate volumes greater than 50% of the internal volume of the mixing container 402, the assembly is arranged at an acute angle with respect to the horizontal surface. The mixing apparatus 400 includes a supporting fixture 404 to hold a supporting disk 406 against the bottom of the mixing container 402 to prevent the container from sliding off the back of the rotating assembly. The disk 406 contacts the bottom of the mixing container 402 and rotates as the mixing container 402 rotates. The mixing container 102 includes an axis 408 that is arranged at an oblique angle with respect to the surface of the substrate 112. During mixing, the mixing container 402 rotates around the axis 408 via rolling of the rollers 110.

In one or more embodiments, the mixing process is performed at atmospheric pressure, or about 1 atmosphere. In other embodiments, a vacuum is applied to the mixing container 102, 402, and the mixing is performed at a vacuum pressure of about 760 Torr to about 10 Torr. In other embodiments, a vacuum is applied to the mixing container 102, 402, and the mixing is performed at a vacuum pressure of about 760 Torr to about 660 Torr.

The inert gas 120 includes, but is not limited to, nitrogen gas ($N_2$), argon gas (Ar), helium gas (He), or any combination thereof. The inert gas 120 is any inert gas or inert gas mixture.

The inert gas 120 is flowed through the gas inlet 106 and through the propellant composition 122 in the mixing container 102, 402 at a flow rate of about 5% of the free volume per minutes to about 100% of the free volume per minute in some embodiments. In other embodiments, the flow rate is about 10% of the free volume per minute to about 50% of the free volume per minute.

In some embodiments, the mixing container 102, 402 is rotated about the central axis 118 or axis 408 at a rate of about 0.2 rotations per minute (rpm) to about 6 rpm. In some embodiments, the mixing container 102, 402 is rotated about the central axis 118 or axis 408 at a rate of about 0.5 rpm to about 2 rpm.

Mixing of the uncured propellant composition is performed for a period of time that can be continuous and include overnight hours without supervision, due to the low energy (temperature and pressure input) into the system, which could typically be dangerous otherwise. According to one or more embodiments, mixing is performed continuously for a period of time of about 4 hours to about 30 hours. In other embodiments, mixing is performed continuously for a period of time of about 8 hours to about 20 hours.

The uncured propellant composition 122 in the mixing container 102, 402 includes solid energetic oxidizer particles, a bonding agent, a binder, and optionally, one or more additives. In some embodiments, the solid energetic particles are nitrogen-container oxidizers. Non-limiting examples of nitrogen-containing oxidizers include ammonium perchlorate, ammonium nitrate and nitramines, such as cyclotetramethylenetetranitramine (HMX) and cyclotrimethylenetrinitramine (RDX). Non-limiting examples of nitrogen-containing oxidizers include chlorates, perchlorates, peroxides, nitrates, nitrites, and permanganates. Further, non-limiting examples of suitable nitrogen-containing oxidizers include triaminoguanidinium azide, diaminoguanidinium azide, monoaminoguanidium azide, monoaminoguanidine, diaminoguanidine, triaminoguanidine, aminotetrazole, diaminotetrazole, 4 amino-3,5-dihydrazino-1,2,4 (4H)-triazole, dihydrazinotetrazine, or any combination thereof. The nitrogen-containing oxidizers can be homopolymers or copolymers of the aforementioned monomers and compounds. Other suitable nitrogen-containing oxidizers to be employed are the high nitrogen containing polymers prepared by condensing one or a mixture of the hereinbefore listed amines with a formaldehyde or glyoxal based material. Still, other suitable polymeric nitrogen-containing oxidizer materials include the poly(guanidines), poly(amino-substituted guanidines), poly'(guanidinium azides), and poly (amino-substituted guanidinium azides). Further, non-limiting examples of suitable nitrogen-containing oxidizers include RDX, HMX, AN, ammonium dinitramide (AND), nitrogen tetroxide (NTO), and the like, or any combination thereof.

Generally, the energetic materials are in the form of solid particles. The average diameter of the particles can be in a range between about 5 and about 200 microns. The nitrogen-containing oxidizer particles can have an average diameter in a range between about 50 and about 100; between 25 and about 125; or between 100 and about 180 microns. In one aspect, the nitrogen-containing oxidizer particles have an average diameter about or in any range between about 5, 10, 20, 30, 40, 50, 60, 70, 80, 90, 100, 110, 120, 130, 140, 150, 160, 170, 180, 190, and 200 microns.

The bonding agent in the propellant composition reacts with at least a portion of the surface of the solid energetic particles to form a chemical or adhesive bond or an encapsulating film. Then, during subsequent curing of the composition, the bonding agent reacts with the binder.

The bonding agent is present in the composition in an amount in a range between about 0.1 and about 1.0 wt. %. In other embodiments, the bonding agent is present in the composition in an amount in a range between about 0.1, 0.2, 0.3, 0.4, 0.5, 0.6, 0.7, 0.8, 0.9, and 1.0 wt. %.

Non-limiting examples of the bonding agent include tetraethylenepentamine acrylonitrile glycidol adducts (also referred to as HX-878 or TEPANOL), reaction products of tetraethylenepentamine and acrylonitrile (also referred to as HX-879 or TEPAN), N,N'-bis(cyanoethyl)-dihydroxypropyl amine (C-1), diethylenetriamine (DETA), or a combination thereof.

The binder that holds together the components of the solid composition can be, e.g., a polymeric binder (i.e., a material that is polymerized to form solid binder), such as polyurethane or polybutadienes ((C4H6)n), e.g., polybutadiene-acrylic acid (PBAA) or polybutadiene-acrylic acid terpolymer (such as polybutadiene-acrylic acid acrylonitrile (PBAN)); hydroxyl-terminated polybutadiene (HTPB), which can be cross-linked with isophorone diisocyanate; or carboxyl terminated polybutadiene (CTPB). Elastomeric polyesters and polyethers can also be used as binders. The binder is polymerized during rocket motor manufacture to form the matrix that holds the solid propellant components together. The binder also is consumed as fuel during burning of the solid composite propellant, which also contributes to overall thrust. The molecular weight of the polymeric binder can be in a range between about 600 and about 3,000 g/mol.

Optionally, additional fuel can be incorporated into the propellant composition. The optional fuel can be a powder of at least one suitable metal or alloy, such as aluminum, beryllium, zirconium, titanium, boron, magnesium, and alloys and combinations thereof. The one or more metals can be pure metals. In some embodiments, the powder particles can be micron sized, e.g., have a maximum dimension of 500 μm or less. Nano-scale powders having a maximum dimension of less than about 500 nm, such as less than about 300 nm or about 100 nm, can also be used. Depending on the composition, method of production, and subsequent processing of the metal powder, the metal powder can have various shapes, including spherical, flake, irregular, cylindrical, combinations thereof, or the like.

Optional stabilizers and processing aids (e.g., catalysts and curing agents) can be added to the composition. These optional additives can include dibutyltin dilaurate, calcium stearate, carbon black and starch.

Figure 2:
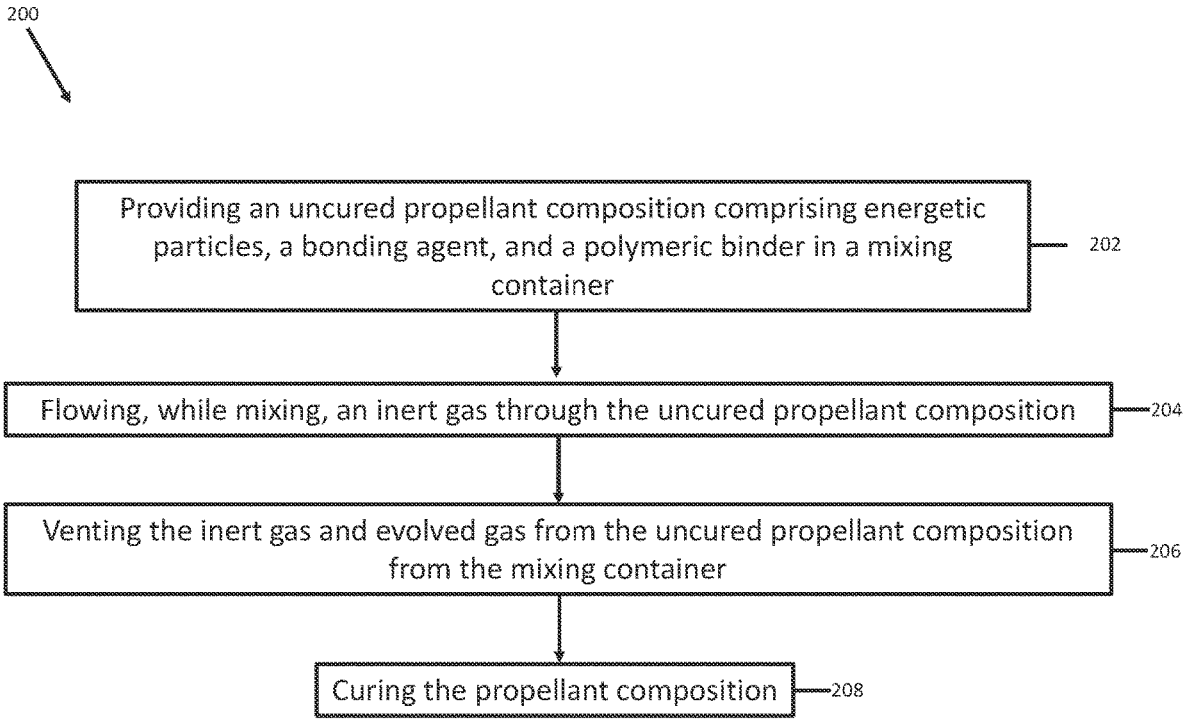
FIG. 2 is a flow chart illustrating a method of removing gases from a propellant composition according to embodiments of the present disclosure.

FIG. 2 is a flow chart illustrating a method 200 of removing gases from an uncured propellant composition according to embodiments of the present disclosure. In block 202, the method includes providing an uncured propellant composition comprising energetic particles, a bonding agent, and polymeric binder in a mixing container. The bonding agent and energetic particles are combined in proportions sufficient to create a thin molecular layer of the bonding agent on the surface of the energetic particles.

The polymeric binder is a liquid, which can be mixed with suitable additives, such as a plasticizers, antioxidants, stabilizers, or any combination thereof.

In block 204, the method includes flowing, while mixing and rotating, an inert gas through the uncured propellant composition to remove undesired evolved gas from the uncured propellant composition. In block 206, the method includes venting the inert gas and evolved gas from the uncured propellant composition from the mixing container.

In block, 208, the method includes curing the propellant composition. Curing converts the mixed material from a viscous fluid to a solid elastomer. Curing can be carried out with a polyisocyanate. Curing is performed at temperatures above room temperature. When polybutadiene is the binder, polyisocyanate forms polybutadiene during curing. Non-limiting examples of polyisocyanates include isophorone diisocyanate (IPDI), dimeryl diisocyanate (DDI), methylene diphenyl diisocyanate (MDI), hexamethylene diisocyanate (HDI), or any combination thereof. Other polyisocyanates known for use in solid energetic formulations also can be used.

The composition is transferred to the desired end item (e.g., rocket motor, sample carton, etc.) and placed in a heated oven until cured. Curing conditions are selected such that an optimal propellant product is obtained by modifying temperature, curing time, catalyst type and catalyst content. A non-limiting example of suitable conditions is curing times between about 3 and 14 days and temperatures between 30 and 70° C.

When additional fuel additives are included in the composition, the fuel additives are added prior to curing. Generally speaking, also minor proportions, for example up to no more than 2.5 wt. % of substances such as phthalates, stearates, copper or lead salts, carbon black, iron containing species, alumina, rutile, zirconium carbide, commonly used stabilizer compounds as applied for energetic compositions (e.g., diphenylamine, 2-nitrodiphenylamine, p-nitromethylaniline, p-nitroethylaniline and centralites) and the like are added to the compositions according to the invention. These additives are known to the skilled person and serve to increase stability, storage characteristics and combustion characteristics.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application. In one or more embodiments, "about" means plus or minus 10%, 9%, 8%, 7%, 6%, 5%, 4%, 3%, 2%, or 1% of the stated value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method for removing a gas from a propellant composition, the method comprising:

providing an uncured propellant composition comprising a bonding agent, energetic particles, and polymeric binder; and flowing an inert gas at room temperature through the uncured propellant composition to remove an evolved gas from the uncured propellant composition.

2. The method of claim 1, wherein the inert gas is nitrogen gas ($N_2$), argon gas (Ar), helium gas (He), or any combination thereof.

3. The method of claim 1, wherein the uncured propellant composition is in a mixing container, and mixing includes rotating the uncured propellant composition around a central axis of the mixing container.

4. The method of claim 3, wherein the mixing container further includes a gas inlet and a vent for flowing the inert gas through the uncured propellant composition and out of the mixing container, respectively.

5. The method of claim 3, further comprising venting the inert gas and the gas from the mixing container.

6. The method of claim 1, wherein the bonding agent is a tetraethylenepentamine acrylonitrile glycidol adduct, reaction product of tetraethylenepentamine and acrylonitrile, C-1, diethylenetriamine, or a combination thereof.

7. A method for removing a gas from a propellant composition, the method comprising:

disposing a bonding agent, energetic particles, and a polymeric binder in a mixing container, the bonding agent, the energetic particles, and polymeric binder forming a propellant composition;

rotating the mixing container about its central axis to mix the propellant composition; and flowing at room temperature, while rotating, an inert gas through the propellant composition to remove an evolved gas from the propellant composition.

8. The method of claim 7, wherein the inert gas is nitrogen gas, argon gas, helium gas, or any combination thereof.

9. The method of claim 7, wherein the mixing container further includes a gas inlet and a vent for flowing the inert gas through the propellant composition.

10. The method of claim 7, further comprising venting the inert gas and the gas from the mixing container.

11. The method of claim 7, wherein the bonding agent is a tetraethylenepentamine acrylonitrile glycidol adduct, reaction product of tetraethylenepentamine and acrylonitrile, N,N'-bis(cyanoethyl)-dihydroxypropyl amine (C-1), diethylenetriamine, or a combination thereof.

* * * * *